US005888023A

United States Patent [19]

Grabe et al.

[11] Patent Number: 5,888,023

[45] Date of Patent: Mar. 30, 1999

[54] SEAL ARRANGEMENT FOR TUBULAR TUNNEL SEGMENTS

[75] Inventors: Werner Grabe, Dülmen; Siegfried Glang, Hamburg; Holger Gutschmidt, Neu Wulmstorf, all of Germany; Bruno Haye, Coulommiers, France

[73] Assignee: Phoenix Aktiengesellschaft, Hamburg, Germany

[21] Appl. No.: 875,642

[22] PCT Filed: Jan. 30, 1996

[86] PCT No.: PCT/DE96/00123

§ 371 Date: Aug. 15, 1997

§ 102(e) Date: Aug. 15, 1997

[87] PCT Pub. No.: WO96/23958

PCT Pub. Date: Aug. 8, 1996

[30] Foreign Application Priority Data

Feb. 1, 1995 [DE] Germany ..... 195 02 991.7

[51] Int. Cl.[6] ..... E21D 11/38

[52] U.S. Cl. ..... 405/152; 52/396.06; 277/626; 404/74; 405/151

[58] Field of Search ..... 405/152, 151, 405/135, 136, 153; 52/396.06, 403; 404/64, 65, 69, 74, 47, 50, 49, 68; 277/626, 625, 612, 615, 565

[56] References Cited

U.S. PATENT DOCUMENTS

| | | | |
|---|---|---|---|
| 3,046,028 | 7/1962 | Nathan | 277/615 |
| 3,052,196 | 9/1962 | Gilmore | 277/565 |
| 3,695,044 | 10/1972 | Hoshino et al. | 405/152 |
| 4,195,850 | 4/1980 | Berger et al. | 405/135 |
| 4,199,158 | 4/1980 | De Munck | 405/135 |
| 4,797,032 | 1/1989 | Glang | 405/152 |
| 4,824,289 | 4/1989 | Glang et al. | 405/152 |
| 4,900,607 | 2/1990 | Glang et al. | 405/152 |
| 4,946,309 | 8/1990 | Glang . | |
| 5,044,823 | 9/1991 | Burgess . | |
| 5,172,919 | 12/1992 | Takasaki et al. . | |

FOREIGN PATENT DOCUMENTS

| | | |
|---|---|---|
| 0 147 764 | 7/1985 | European Pat. Off. . |
| 0 340 659 | 8/1992 | European Pat. Off. . |
| 0 522 912 | 1/1993 | European Pat. Off. . |
| 0 449 082 | 10/1993 | European Pat. Off. . |
| 2 669 259 | 5/1992 | France . |
| 2 678 680 | 1/1993 | France . |
| 2 712 655 | 5/1995 | France . |
| 44 00 292 | 7/1994 | Germany . |
| 2 214 994 | 9/1989 | United Kingdom . |

*Primary Examiner*—Dennis L. Taylor
*Attorney, Agent, or Firm*—Collard & Roe, P.C.

[57] ABSTRACT

The invention relates to a seal arrangement consisting of two abutting structures of concrete, steel, reinforced concrete, cast iron or other materials and a sealing section of elastomeric material which bridges and seals the gap between the two structures, in which the structures are especially segments assembled to form a tubular tunnel with the formation of transverse and longitudinal seams, where each segment preferably has at least one peripheral recess covering all the mating sides of the segments and there is in each recess a stranded sealing section which especially has strand-shaped grooves on the base side of the sealing section and/or strand-shaped channels, forming a sealing frame with corners, and the back of the sealing section has at least one strand-shaped groove to accept an emergency seal. When the segments are moved in the direction of the arrow, giving rise to gaps, the emergency seal, consisting especially of a water-activatable sealing material, can expand as a result of a swelling process with an increase in volume.

12 Claims, 5 Drawing Sheets

SEAL ARRANGEMENT FOR TUBULAR TUNNEL SEGMENTS

BACKGROUND OF THE INVENTION

1. Field of the Invention

The invention relates to a seal arrangement consisting of two abutting structural parts made of concrete, steel, reinforced concrete, cast iron, or other materials (e.g. synthetic resins), as well as of a sealing section made of elastomeric material (i.e., rubber or rubber-like material), which bridges and seals the gap between the two structural parts, whereby the structural parts particularly are segments assembled to form a tubular tunnel with the formation of transverse and longitudinal joints, whereby each segment preferably is provided with at least one peripheral recess covering all the mating sides of the segment, and whereby a sealing section extending in the form of a strand is present in each recess, such sealing section being provided particularly with grooves extending in the form of strands, such grooves being arranged on the base side of the sealing section, and/or with channels extending in the form of strands as well, forming a sealing frame with frame corners. As the segments have four mating sides in most cases, the sealing frame consists of four assembled-sealing sections, whereby the corners of the frame are preferably manufactured by the injection molding process.

2. The Prior Art

A seal arrangement according to the above type is known, for example from U.S. Pat. No. 4,946,309. Due to the compression of the abutting structural parts or segments with reduction of the spacing of the gap or transverse and longitudinal joints, the sealing section made of elastomeric material develops its sealing capacity under the interaction of force and reactive force. Such compression seals are successfully used in connection with numerous tunnel projects.

For the purpose of additional pressure activation, it has been proposed, furthermore, to provide a sealing section toward the water side with a lateral bore, which is connected with at least one of the channels extending in the form of strands (U.S. Pat. No. 5,044,823). When water penetrates from the outer side of the segment, the channel or the channels is/are supported by the water pressure, which leads to an increase in the sealing capacity. However, the drawback is that the bore may be closed due to soiling, resulting in inefficiency of said additional pressure-activating measure.

Furthermore, a seal arrangement is introduced in EP-B-0 340 659, in which the sealing section has a hollow space connected with an injection channel. The sealing section is activated by means or an injectable medium increasing the total volume. In this way, a high sealing effect is obtained without requiring compression of the sealing sections during assembly. However, the drawback in this connection is that an injection channel has to be made available, which, furthermore, frequently has to be extended through the segments, and that additional device parts are needed.

French laid-open patent specifications 2 669 259, 2 678 680, and 2 712 655 introduce seal arrangements in which the back of the sealing section has at least one groove extending in the form of a strand, for which provision is made for the purpose of receiving an emergency seal, in particular an activatable, and especially a water-activatable sealing material. Here, the back of the sealing section may have one single groove. Another possibility is to fit the back of the sealing section with two grooves, which are arranged substantially mirror-symmetrically relative to each other based on the vertical plane of the center of the section (EP-A-0 522 912).

In spite of numerous solutions proposed for sealing abutting structural parts, the problem has not been solved adequately heretofore. Structural parts, especially tunnel segments, may change in their positions relative to each other in the course of time (e.g. due to the action of conditions caused by geological changes), for example due to ovalizing, so that gaps open up. Moreover, structural parts or tunnel segments may be dislocated with displacement when installed. Such constellations then necessarily lead to a negative influence on the sealing efficiency of the sealing section.

SUMMARY OF THE INVENTION

For said reasons, a seal arrangement is proposed according to the invention, in which the back of the sealing section has at least one groove extending in the form of a strand.

With respect to the constructional design of the groove and the emergency seal installed therein, use is made of the following variations:

(1) The flanks of the groove extend in the form of an arc, whereby such flanks, furthermore, change into the bottom of the groove in a curved way, forming a groove having a substantially circular cross section particularly in connection with an approximately funnel-shaped opening.

With a substantially circular cross section, the emergency seal now can be installed in said groove, for example in the form of a cord.

According to another useful design variation, use is made of an emergency seal which substantially completely fills the groove, whereby the top sealing surface of the emergency seal extends approximately aligned with the back of the sealing section, or has a flange-like widening gripping around the back of the section.

(2) The flanks of the groove extend in a double-conical or concave form, whereby the groove has its greatest width within the range of half of the depth of the groove, with a substantially plane-surfaced bottom of the groove. In this case, too, reference is made to the advantageous variations according to number (1) above with respect to the installed emergency seal. The use of an emergency seal in the form of a cord is particularly useful in connection with this design of (3) The flanks of the groove extend conically, specifically with-reduction of the width of the groove toward the bottom of the groove, namely with a groove bottom having a substantially plane surface, whereby the groove is equipped with retaining noses extending strand-like, such retaining noses preventing the emergency seal from dropping out. One single retaining nose is present within each frank of the groove, whereby the two retaining noses facing each other are approximately arranged slightly below the back of the sealing section.

In the present case, the emergency seal usefully has the shape of a strip, specifically a strip having a substantially rectangular or trapezoidal cross section shape. In this connection, it is advantageous if not the entire groove is filled with the emergency seal, but if a clear space is formed between the back of the sealing section and the emergency seal.

Furthermore, it is useful if the corners of the sealing frame are equipped with at least one groove as well, such groove changing aligned into the groove of the sealing section, whereby reference is made to the statements according to Nos. 1 to 3 with respect to the advantageous design variations of the groove and emergency seal.

Moreover, it is useful if the emergency seal is installed in the groove only immediately before the structural parts or segments are assembled. This is especially important with an emergency seal consisting of a water-activatable sealing material (e.g. Hydrotite®).

Additional constructional design variations of the sealing section are introduced within the framework of the description of the figures.

BRIEF DESCRIPTION OF THE DRAWINGS

The invention is explained in the following on exemplified embodiments by reference to schematic drawings, in which.

DETAILED DESCRIPTION OF PREFERRED EMBODIMENTS

Figure 1:
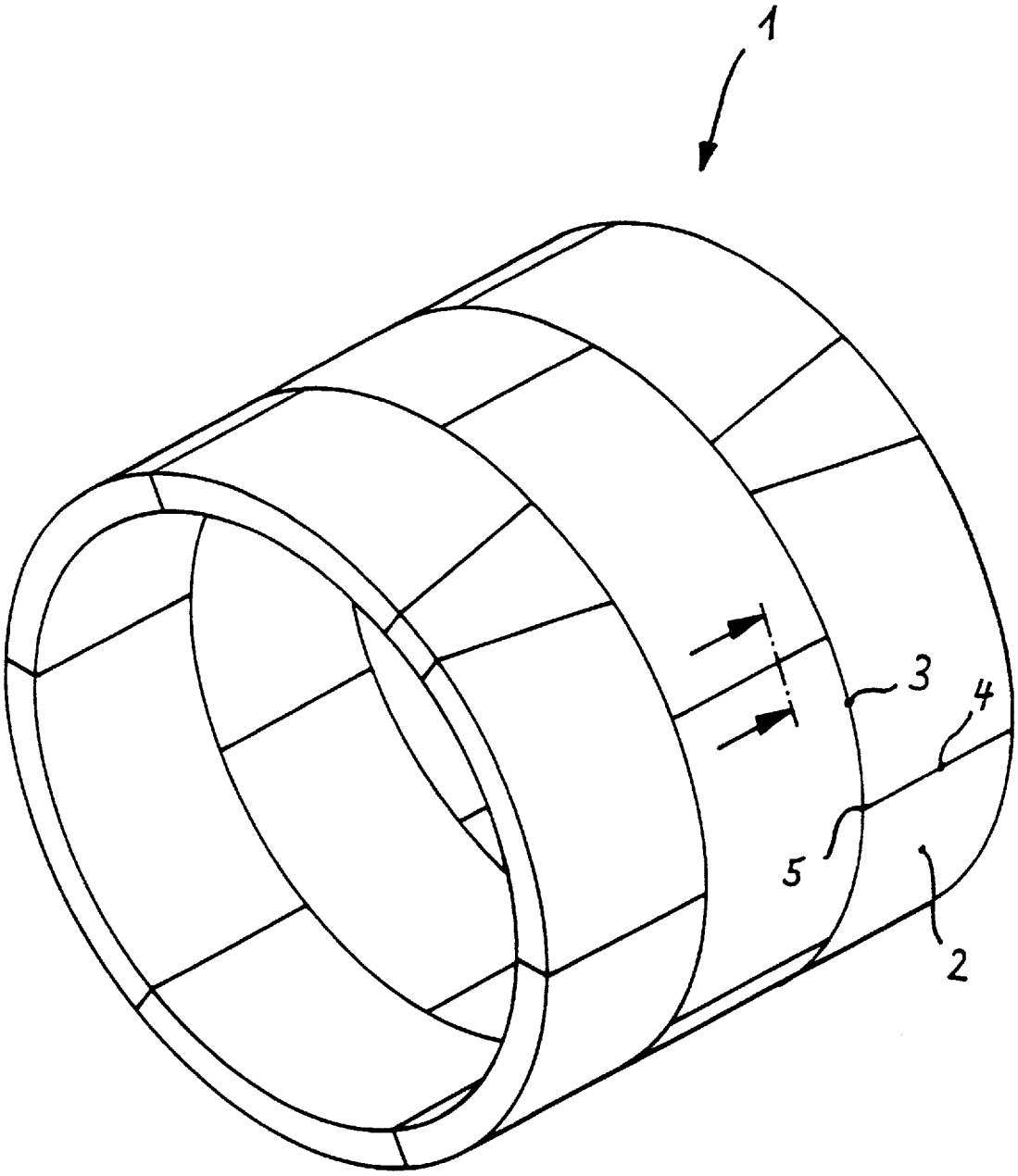
FIG. 1 shows a tunnel consisting of segments as well as longitudinal and transverse joints.
Figure 2:
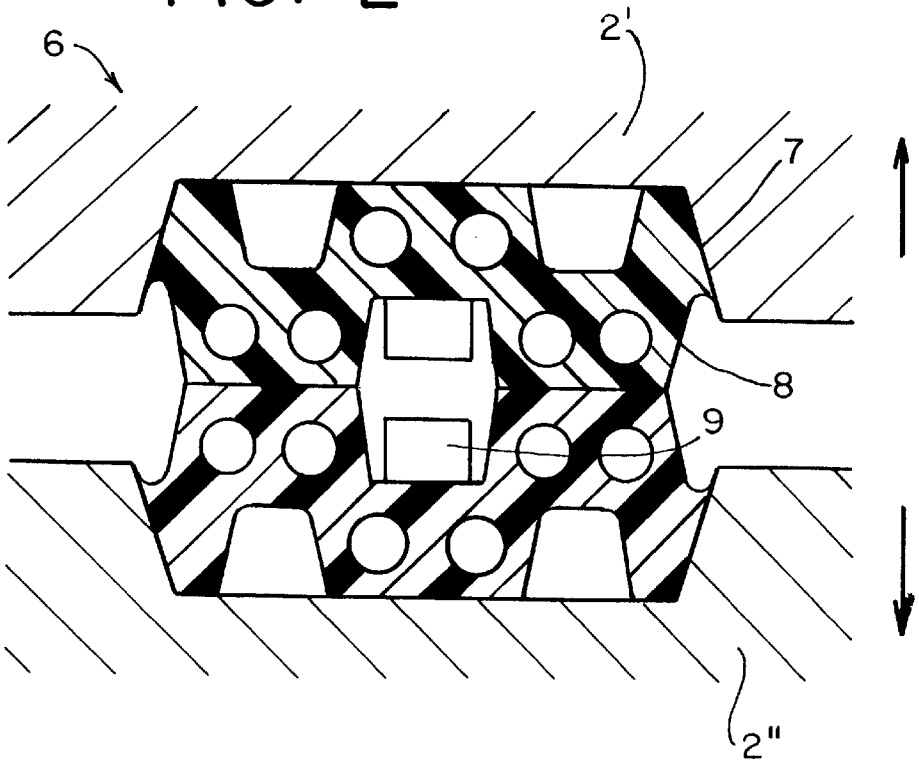
FIG. 2 shows a seal arrangement without displacement.
Figure 3:
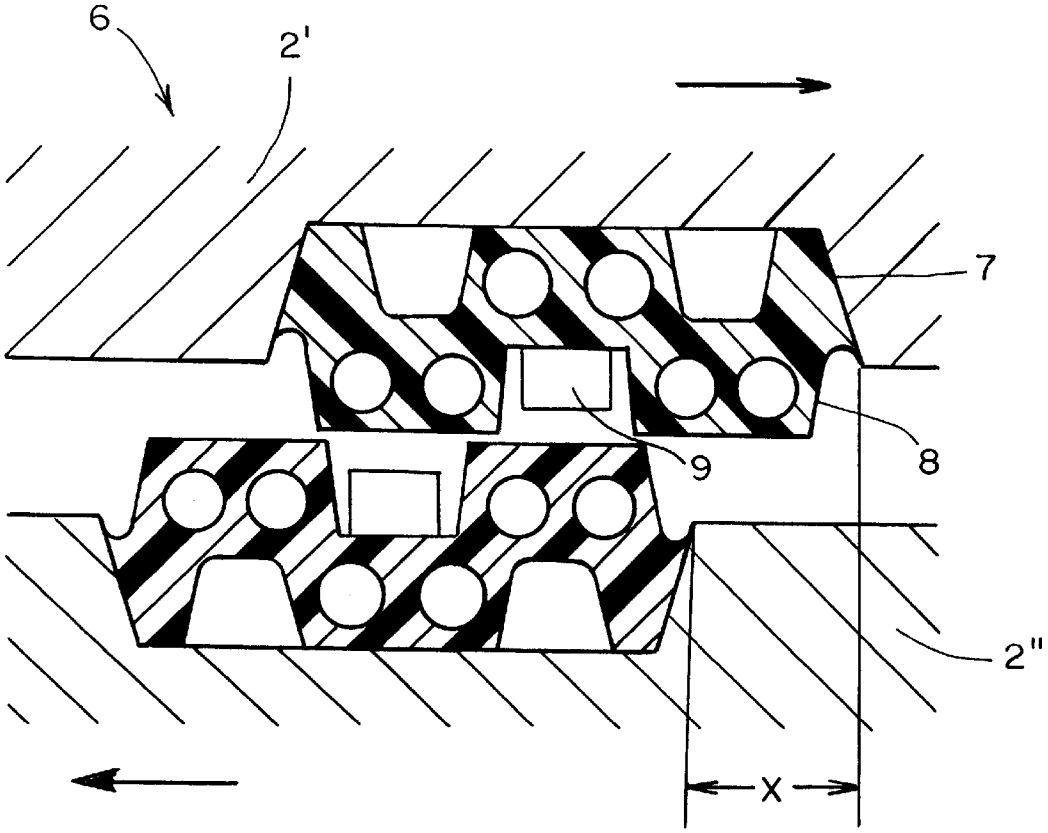
FIG. 3 shows a seal arrangement with displacement.
Figure 4:
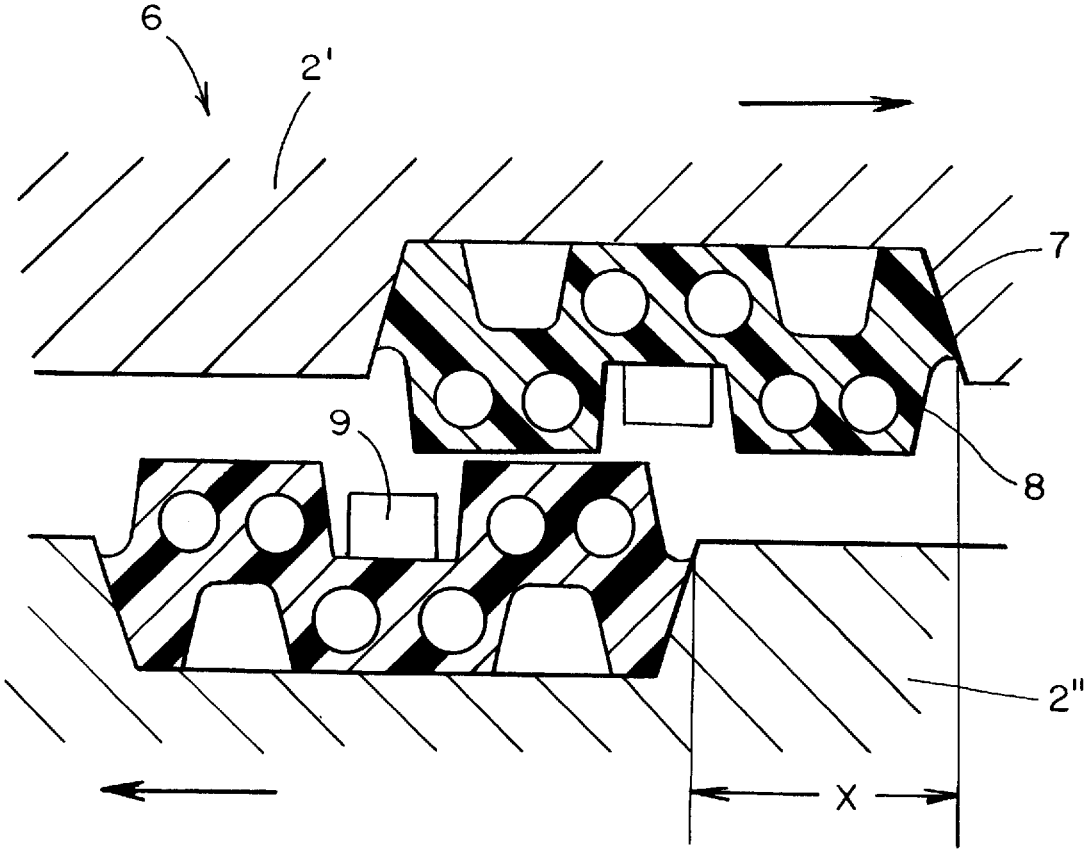
FIG. 4 shows a seal arrangement with very extensive displacement.

FIGS. 2 to 4 contain cross sectional representations of the longitudinal joint according to section line A—A (FIG. 1). Although the grooves and channels change their form in the stressed condition (i.e., under the action of pressure), said parts of the section are shown within the framework of the drawings in their original form.

FIGS. 5 to 11, on the other hand, show the unstressed condition. The same applies to the constructional descriptions of the sealing section, groove and emergency seal contained in the claims.

The following list of reference numerals applies in connection with the figures:

1 Tunnel
2 Segment
2' Segment
2" Segment
3 Transverse joint (annular joint)
4 Longitudinal joint
5 T-joint arrangement
6 Seal arrangement
7 Recess
8 Sealing section
8' Sealing section
9 Emergency seal
10 Back of sealing section
11 Groove
12 Flank
13 Groove bottom
14 Retaining nose
15 Base side of sealing section
16 Channel
17 Fluted groove
18 Channel
19 Emergency seal in strip form
20 Clear space
21 Sealing section
22 Groove
23 Groove
24 Channel
25 Groove
26 Flank
27 Groove bottom
28 Funnel-like opening
29 Emergency seal
30 Sealing surface with flange-like widening
31 Groove
32 Flank
32' Flank
33 Groove bottom
34 Flank
35 Emergency seal
36 Sealing surface
36' Sealing surface
37 Clear space FIG. 1 shows a tunnel consisting of segments 2 with the formation of transverse and longitudinal joints 3 and 4, respectively, as well as a T-joint arrangement 5.

FIG. 2 shows a seal arrangement 6 consisting of two abutting segments 2' and 2" each provided with a recess 7, with a sealing section 8 made of elastomeric material installed in each recess. In the optimal position (compressed condition of the two sealing sections without displacement), the integrated emergency seal 9 has no effect, to begin with; the primary sealing effect is assumed here by the sealing sections 8 (compression seals).

According to the invention, emergency seal 9 is put into action when the following constellations occur:

(a) Segments 2' and 2" are displaced in the direction of the arrow according to FIG. 2, causing gaps to open up.

(b) Segments 2' and 2" are displaced when installed, with displacement "X" in the direction of the arrow according to FIGS. 3 and 4.

Since the emergency seal consists of a water-activatable sealing material, the additional sealing effect can develop in the presence of air humidity or penetrating water due to swelling of the emergency seal (activated seal), causing its volume to increase.

Figure 5:
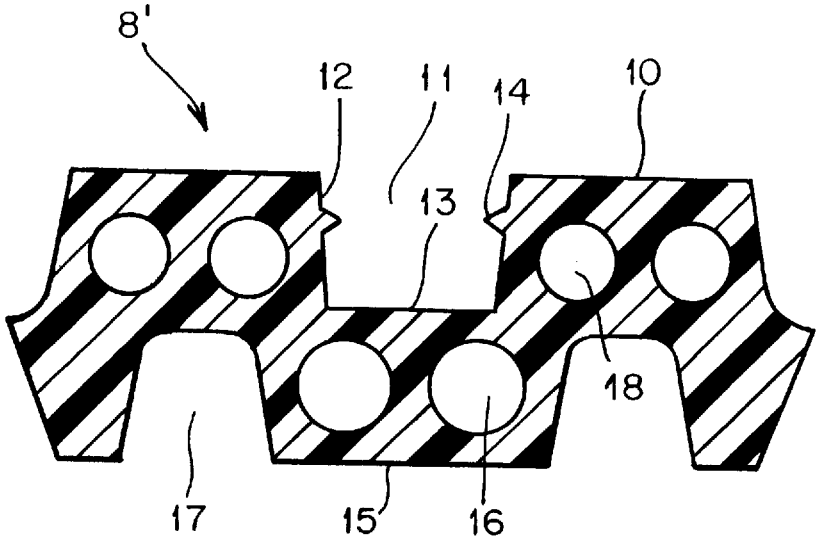
FIG. 5 shows a sealing section with one single groove and retaining noses.

FIG. 5 shows a sealing section 8' having a back 10 fitted with one single groove 11 located within the center of the section. The flanks 12 of said groove extend conically, with reduction of the width of the groove toward bottom 13 of the latter. The groove is provided with retaining noses 14, which are arranged within flanks 12 slightly below back 10, facing each other.

Two channels 16 are arranged between the substantially plane bottom 13 of the groove and base side 15 of the sealing section, such channels being framed by two fluted gooves 17. In addition, two additional channels 18 are arranged on each of the two sides of groove 11.

Figure 6:
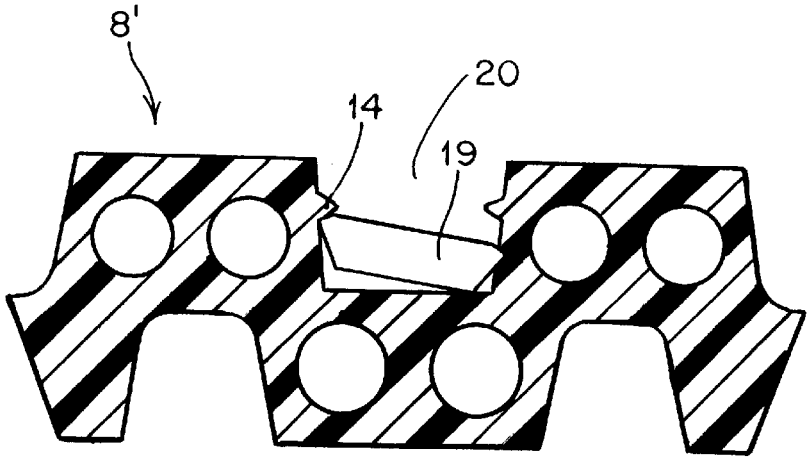
FIG. 6 shows a sealing section according to FIG. 5 with an installed emergency seal.

Now, FIG. 6 shows the same sealing section 8' according to FIG. 5; however, in this case, emergency seal 19 is installed in the form of a strip which, viewed cross-sectionally, has a trapezoidal shape, such strip not filling the groove completely, but forming a clear space 20 as well. The retaining noses 14 here prevent emergency seal 15 from dropping out.

Figure 7:
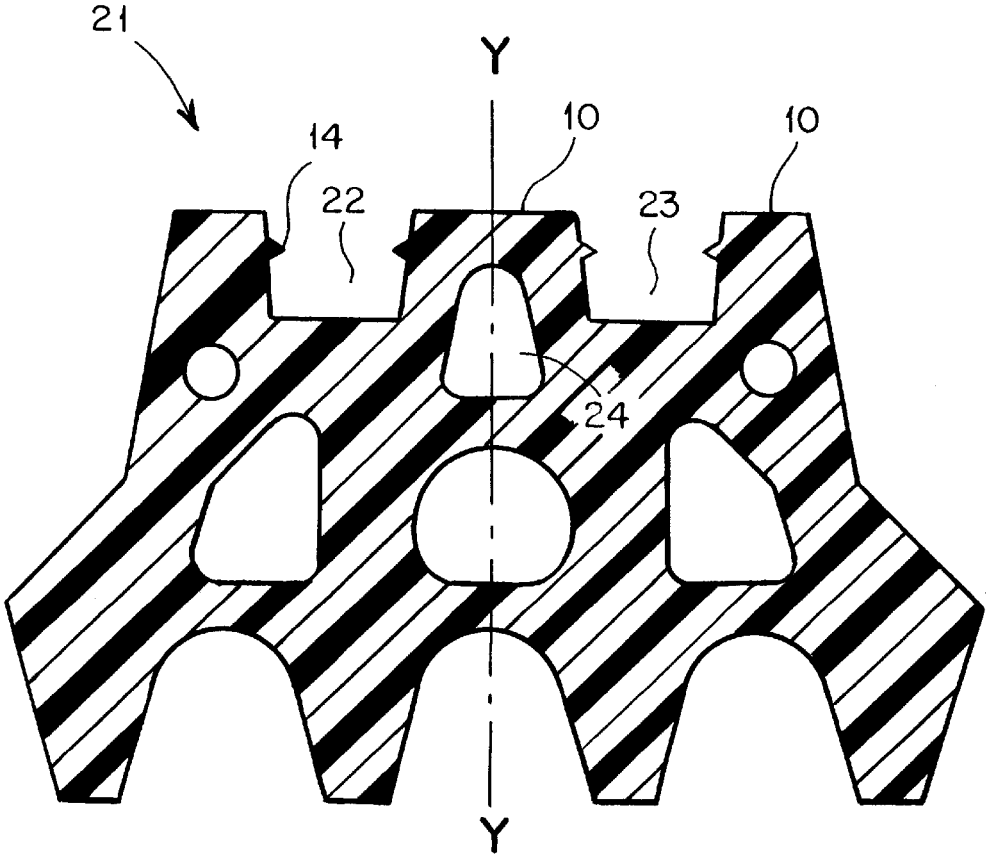
FIG. 7 shows a sealing section with two grooves and retaining noses.

According to FIG. 7, back 10 of sealing section 21 has two grooves 22 and 23, which are arranged mirror-symmetrically (based on vertical plane "Y" of the center of the section) relative to each other, whereby a channel 24 is present between said two grooves, in a total arrangement of three rows of grooves and channels. Reference is made to FIG. 6 with respect to the interaction between the retaining noses 14 and the emergency seal.

Figure 8:
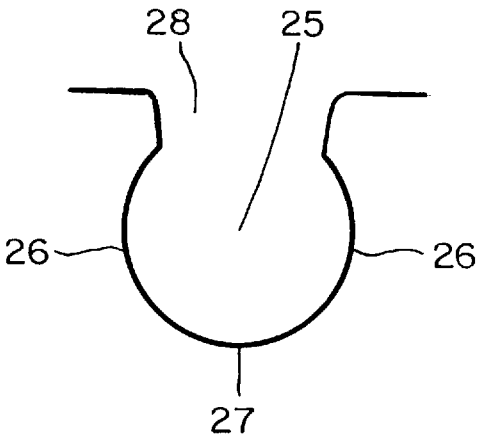
FIG. 8 shows a sealing section with a groove having a substantially circular cross sectional shapes.

FIG. 8 shows a groove 25 having the flanks 25 extending in the form of an arc, whereby said flanks, furthermore, change into the groove bottom 27 in a curved way, forming thereby a groove with a substantially circular cross section. The groove itself has an approximately funnel-like opening 28.

Figure 9:
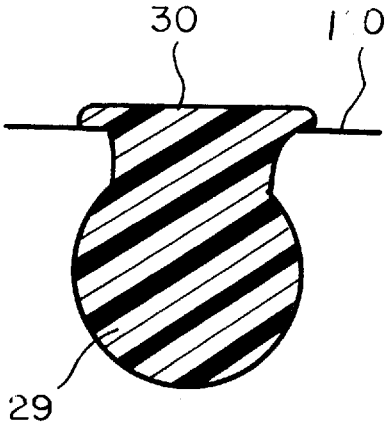
FIG. 9 shows a sealing section according to FIG. 8 with an installed emergency seal with a flange-like widening of the sealing surface.

Now, according to FIG. 9, the groove according to FIG. 8 is completely filled with emergency seal 29, whereby the sealing surface 30, furthermore, has a flange-like widening gripping around back 10 of the sealing section.

Figure 10:
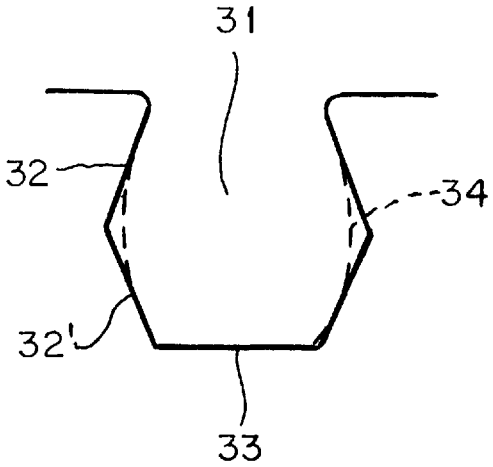
FIG. 10 shows a sealing section with one groove having flanks extending double-conically or concavely.

FIG. 10 shows a groove 31 having the flanks 32 and 32', respectively, extending in the form of a double-cone, whereby the groove has its greatest width within the range of half of the depth of the groove, with a substantially plane-surfaced groove bottom 33.

Another alternative is shown within the framework of said figures with respect to the course of the flank, specifically in the form of a concavely extending flank 34 (shown by dashed lines).

Figure 11:
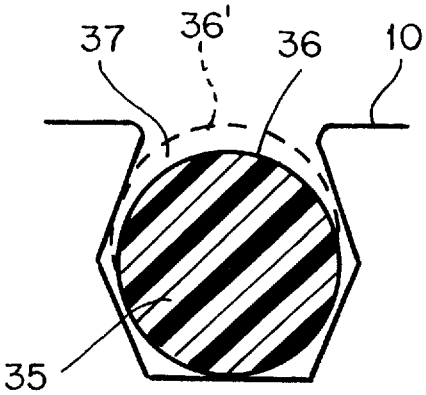
FIG. 11 shows a sealing section according to FIG. 10 with an emergency seal installed in the form of a cord.

Now, FIG. 11 shows a groove according to FIG. 10 with flanks extending in the form of a double-cone, whereby the emergency seal 35 installed in the groove is present in the form of a cord having a substantially circular cross-sectional shape. Sealing surface 36 of the emergency seal is located here slightly below back 10 of the sealing section, forming a clear space 37, whereby as a variation, sealing surface 36' also may extend aligned with back 10 (dashed lines).

Even though the seal arrangement is of primary importance within the framework of tunnel construction, its principle is applicable to other building constructions as well, for example for sealing socket pipes in sewer construction (EP-B-0 449 082).

We claim:

1. Seal arrangement comprising two abutting structural parts made of a material selected from the group consisting of concrete, steel, reinforced concrete, and cast iron, and a sealing section made of elastomeric material for sealing and bridging a gap between the two structural parts;

said structural parts being segments assembled to form a tubular tunnel with a formation of transverse joints and longitudinal joints, each segment having a mating side and being provided on the mating side with at least one peripheral recess covering all mating sides of the segment;

said sealing section extending in the form of a strand being present in each recess, said sealing section being provided with fluted grooves extending in a form of strands, said fluted grooves being located on a base side of the sealing section; and with channels extending in the form of strands and forming a sealing frame with frame corners;

said sealing section having a back, said back having at least one groove extending in the form of a strand, said groove receiving an emergency seal, which is a water-activatable sealing material; and said groove having flanks, and the flanks of the groove being curved, said flanks changing into a bottom of the groove in a curved way, forming a groove with a substantially circular cross-sectional shape; and the groove having an approximately funnel shaped opening.

2. Seal arrangement comprising two abutting structural parts made of a material selected from the group consisting of concrete, steel, reinforced concrete, and cast iron, and a sealing section made of elastomeric material for sealing and bridging a gap between the two structural parts;

said structural parts being segments assembled to form a tubular tunnel with a formation of transverse joints and longitudinal joints, each segment having a mating side and being provided on said mating side with at least one peripheral recess covering all mating sides of the segment;

said sealing section extending in a form of a strand and being present in each recess, said sealing section being provided with fluted grooves extending in the form of strands, said grooves being located on a base side of the sealing section and with channels extending in a form of strands;

said sealing section having a back, said back having at least one groove extending in the form of a strand, said groove receiving an activatable emergency seal; and said groove having flanks, a width, a depth and a bottom, said flanks of the groove extend selected from the group consisting of double-conically or concavely, said groove having greatest width within a range of half of the depth of the groove, and with a substantially plane groove bottom.

3. Seal arrangement comprising two abutting structural parts made of a material selected from the group consisting of concrete, steel, reinforced concrete and cast iron, and a sealing section made of elastomeric material for sealing and bridging a gap between the two structural parts;

said structural parts being segments assembled to form a tubular tunnel, with a formation of transverse joints and longitudinal joints, each segment having a mating side and being provided on said mating side with at least one peripheral recess covering all mating sides of the segment; said sealing section extending in a form of a strand and being present in each recess, said sealing section being provided with fluted grooves extending in a form of strands; said grooves being located on a base side of the sealing section, and with channels extending in a form of strands forming a sealing frame with frame corners;

said sealing section having a back, said back of the sealing section having at least one groove extending in a form of a strand, said groove receiving an emergency seal; said groove having flanks, a groove width, a groove bottom, and said flanks of the groove extend conically, reducing the width of the groove toward the groove bottom, with a substantially plane groove bottom; and said groove fitted with retaining noses extending in a form of strands, said retaining noses preventing the emergency seal from dropping out, in a way such that one single retaining nose is present within each flank of the groove; and two retaining noses facing each other are arranged slightly below the back of the sealing section.

4. Seal arrangement according to claim 1, wherein the back of the sealing section has one single groove located within a zone of a center of the section; and at least one channel is located on each of two sides of the groove.

5. Seal arrangement according to claim 1, wherein the back of the sealing section has two grooves arranged substantially mirror-symmetrically relative to each other based on a vertical plane of a center of the section; and at least one channel is located between the two grooves.

6. Seal arrangement according to claim 1, wherein the emergency seal is a strip with a cross-sectional shape selected from the group consisting of rectangular and trapezoidal.

7. Seal arrangement according to claim 1, wherein the emergency seal is a cord with a circular cross-sectional shape.

8. Seal arrangement according to claim 1, wherein the emergency seal does not fill the groove completely, forming a space between the back of the sealing section and the emergency seal.

9. Seal arrangement according to claim 1, wherein the emergency seal fills the groove substantially completely, and a top sealing surface of the emergency seal extends approximately aligned with the back of the sealing section.

10. Seal arrangement according to claim 1, wherein the emergency seal fills the groove substantially completely, and a top sealing surface has a flange-like widening gripping around the back of the sealing section.

11. Seal arrangement according to claim 1, wherein the frame corners of the sealing frame have at least one groove, and said groove becoming aligned with the groove of the sealing section when placed in the groove of the sealing section.

12. Seal arrangement according to claim 1, wherein the emergency seal is located within the groove immediately prior to the assembly of the structural parts and the segments.

* * * * *